US011287214B2

(12) United States Patent
Robinson

(10) Patent No.: US 11,287,214 B2
(45) Date of Patent: Mar. 29, 2022

(54) ADJUSTABLE SLING FOR A FIREARM

(71) Applicant: WHG Properties, LLC, North Wales, PA (US)

(72) Inventor: Frank E. Robinson, Schwenksville, PA (US)

(73) Assignee: WHG Properties, LLC, North Wales, PA (US)

( * ) Notice: Subject to any disclaimer, the term of this patent is extended or adjusted under 35 U.S.C. 154(b) by 182 days.

(21) Appl. No.: 16/739,279

(22) Filed: Jan. 10, 2020

(65) Prior Publication Data

US 2021/0215452 A1 Jul. 15, 2021

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01)

(58) Field of Classification Search
CPC ..... F41C 33/002; F41C 23/02; F41C 33/001; Y10S 224/913
See application file for complete search history.

(56) References Cited

U.S. PATENT DOCUMENTS 1,396,270 A * 11/1921 Grierson ..... F41C 33/001 224/150
2,343,118 A * 2/1944 White ..... A44B 11/04 24/198
4,511,070 A * 4/1985 Hightower ..... F41C 23/02 224/150
4,608,735 A * 9/1986 Kasai ..... A44B 11/10 24/171
D328,044 S * 7/1992 Murai ..... 24/169
D340,008 S * 10/1993 Anscher ..... D11/218
5,802,756 A * 9/1998 Hightower ..... F41C 33/002 42/85
5,810,219 A * 9/1998 Rosenfield ..... F41C 33/001 224/149
6,068,167 A * 5/2000 Hopson ..... A45C 13/30 224/150
6,325,258 B1 * 12/2001 Verdugo ..... F41C 33/001 224/149
6,371,346 B1 * 4/2002 Sharma ..... A45F 3/14 224/195
7,059,502 B2 * 6/2006 Johnson ..... F41C 33/002 224/150
7,988,023 B1 8/2011 Nykoluk
8,596,504 B2 12/2013 Haley, Sr. et al.
9,157,700 B1 * 10/2015 Hansen ..... F41C 33/002
9,291,425 B2 * 3/2016 Golob ..... F41C 33/002
(Continued)

FOREIGN PATENT DOCUMENTS

WO WO-2019018783 A1 * 1/2019 ..... F41C 33/002

OTHER PUBLICATIONS

Sheriff of Baghdad, B-Sling with HK Hook at https://sobtacticalshop.com/store/slings/b-sling-with-hk-hook/ (Oct. 28, 2019).
(Continued)

*Primary Examiner* — Brian D Nash
(74) *Attorney, Agent, or Firm* — Fox Rothschild LLP

(57) ABSTRACT

The disclosure relates to an adjustable firearm sling that allows a user to rapidly adjust orientation of the firearm between resting and firing positions.

22 Claims, 4 Drawing Sheets

(56) References Cited

U.S. PATENT DOCUMENTS

| | | | | |
|---|---|---|---|---|
| 9,410,766 | B1 * | 8/2016 | Falla | F41C 33/002 |
| 9,557,138 | B2 | 1/2017 | Alford | |
| 9,746,284 | B2 | 8/2017 | McCarthy | |
| 10,209,031 | B2 * | 2/2019 | Lance | F41C 23/02 |
| 10,281,235 | B1 * | 5/2019 | White | F41C 23/02 |
| 10,473,424 | B2 * | 11/2019 | Weimer | F41C 33/002 |
| D869,594 | S * | 12/2019 | Lance | D22/108 |
| 2004/0188476 | A1 * | 9/2004 | Johnson | F41C 33/002 224/150 |
| 2006/0011677 | A1 * | 1/2006 | Burnsed | F41C 33/001 224/150 |
| 2007/0257072 | A1 * | 11/2007 | Pena | F41C 23/02 224/150 |
| 2008/0263836 | A1 * | 10/2008 | Howell | A44B 11/2592 24/614 |
| 2008/0302838 | A1 * | 12/2008 | Burnsed, Jr. | F41C 33/002 224/150 |
| 2014/0203053 | A1 * | 7/2014 | Rivas-Schlanger | F41C 23/02 224/150 |
| 2015/0292835 | A1 * | 10/2015 | McCarthy | F41C 23/02 24/599.6 |
| 2016/0265873 | A1 * | 9/2016 | Schuman | F41C 33/002 |
| 2017/0191793 | A1 * | 7/2017 | McLean | F41C 23/02 |
| 2017/0205192 | A1 * | 7/2017 | Weimer | F41C 33/002 |
| 2020/0400402 | A1 * | 12/2020 | Freitas | F41C 23/02 |

OTHER PUBLICATIONS

Lead Faucet Tactical, LFT Sling (Oct. 2019).
Sly Tactical, Two Point Sling w/o Padding (Oct. 2019).
Blue Force Gear, Vickers Sling (Oct. 2019).
Magpul, MS1® Sling (Oct. 2019).

* cited by examiner

ADJUSTABLE SLING FOR A FIREARM

FIELD

The disclosed technology relates to a tactical firearm sling that can be quickly and easily adjusted between an orientation in which the firearm is at rest and an orientation in which the firearm is in use (i.e., when the user is ready to fire the weapon).

BACKGROUND

Slings are regularly used as a convenient means for carrying and retaining firearms, such as rifles. Slings can be provided in various configurations, including one-point, two-point, and multi-point configurations. In general, a two point tactical sling attaches to the firearm at two positions, one near the front end (e.g., on the handguard or upper receiver) and another near the rear end (e.g., on the stock). Slings swivels are often used to secure a sling to a weapon. Typically, a sling swivel is rotatable at the attachment point and provides a loop through which a portion of the sling strap may be threaded.

Once a sling is attached, the firearm can be comfortably carried in front of the user's body. An adjustable sling can be tightened to keep the firearm close to the user's body when the firearm is in a carrying position, and can be loosened so that the user is able to move the firearm into a shooting position, such as when the user is standing, kneeling, or prone. Sling adjustability is particularly important in a dynamic environment where a user may need to rapidly change the firearm from a carrying position to a shooting position, and vice versa. Even a small reduction in the amount of time it takes a user to shorten or lengthen the sling can be critical in combat situations and other active environments.

Thus, there is a need for an improved adjustable sling that requires less time and effort to change the position of the weapon between resting and shooting positions.

SUMMARY

The present disclosure relates generally to an adjustable firearm sling that allows a user to rapidly adjust orientation of the firearm between resting and firing positions.

In one aspect, the disclosed technology relates to an adjustable sling for a firearm, including: a primary adjustable strap having a front portion and a back portion, wherein the front portion of the primary adjustable strap is configured to be coupled to a firearm attachment member directly mounted at or near a front end of a firearm; a rapid adjustment buckle including three apertures and a slot, the rapid adjustment buckle having a front end and a back end; a strap connector; and a loop cord aperture, wherein the rapid adjustment buckle is configured to be positioned between the firearm attachment member and the strap connector, and the back portion of the primary adjustable strap is coupled to the rapid adjustment buckle via the strap connector; the rapid adjustment buckle is configured to slide between the firearm attachment member directly mounted at or near the front end of the firearm and the strap connector; and the loop cord aperture is positioned behind the back end of the rapid adjustment buckle. In one embodiment, a portion of the primary adjustable strap positioned between the rapid adjustment buckle and the strap connector includes a plurality of layers of strap material, a portion of which defines the loop cord aperture. In another embodiment, the loop cord aperture is configured to receive a loop cord extending therethrough in a snug fit. In another embodiment, the adjustable sling further includes a loop cord extending through the loop cord aperture. In another embodiment, the loop cord includes two ends coupled to the slot. In another embodiment, the loop cord includes paracord.

In another embodiment, the adjustable sling further includes a fixed strap having a front end and a back end, wherein the strap connector is further coupled to the front end of the fixed strap. In another embodiment, the back end of the fixed strap is configured to be coupled to a firearm attachment member directly mounted at or near a back end of a firearm. In another embodiment, the adjustable sling further includes a secondary adjustable strap positioned between the fixed strap and the firearm attachment member directly mounted at or near the front end of the firearm. In another embodiment, the secondary adjustable strap is coupled to the firearm attachment member directly mounted at or near the front end of the firearm via an intermediate attachment member. In another embodiment, the adjustable sling further includes an intermediate attachment member coupled to the primary adjustable strap and positioned in front of the front end of the rapid adjustment buckle. In another embodiment, the rapid adjustment buckle includes grips on two opposing sides of the rapid adjustment buckle.

In another aspect, the disclosed technology relates to a firearm, including: an adjustable sling including: a primary adjustable strap having a front portion and a back portion, wherein the front portion of the primary adjustable strap is coupled to a firearm attachment member directly mounted at or near a front end of the firearm; a rapid adjustment buckle including three apertures and a slot, the rapid adjustment buckle having a front end and a back end; a strap connector; and a loop cord aperture, wherein the rapid adjustment buckle is positioned between the firearm attachment member and the strap connector, and the back portion of the primary adjustable strap is coupled to the rapid adjustment buckle via the strap connector; the rapid adjustment buckle is configured to slide between the firearm attachment member directly mounted at or near the front end of the firearm and the strap connector; and the loop cord aperture is positioned behind the back end of the rapid adjustment buckle. In one embodiment, the firearm includes a handguard and the front portion of the primary adjustable strap is coupled to a firearm attachment member directly mounted to the handguard.

In another aspect, the disclosed technology relates to an adjustable sling for a firearm, including: a first strap including a front portion configured to engage a firearm attachment member directly mounted at or near a front end of the firearm, and a back portion; a rapid adjustment buckle slidably positioned on the first strap and including a first portion with a first and a second elongated aperture formed therein, the first elongated aperture being spaced apart from the second elongated aperture, the rapid adjustment buckle being configured so that the strap enters and exits buckle by way of the first and second elongated apertures as the buckle slides along the first strap; and a strap connector configured to couple the first strap to a second strap; wherein the first strap is configured to loop around a portion of the strap connector, and the back portion of the first strap is permanently secured to a second portion of the rapid adjustment buckle so that the first strap forms a loop between the rapid adjustment buckle and the strap connector, and wherein sliding the rapid adjustment buckle toward the strap connector decreases a size of the loop and increases a length of the strap between the firearm attachment member and the strap connector. In one embodiment, sliding the rapid adjustment buckle away from the strap connector increases a size of the loop and decreases the length of the strap between the firearm attachment member and the strap connector. In another embodiment, the first strap loops around the portion of the strap connector after exiting the rapid adjustment buckle. In another embodiment, the first strap loops around the portion of the strap connector by way of an aperture in the strap connector. In another embodiment, the first strap further includes an intermediate portion located between the front and back portions, and the rapid adjustment buckle is further configured to slide along the intermediate portion.

In another aspect, the disclosed technology generally relates to a firearm having an adjustable sling as disclosed herein.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated herein and constitute part of this specification, are illustrative of particular embodiments of the present disclosure and do not limit the scope of the present disclosure. The drawings are not to scale and are intended for use in conjunction with the explanations in the following detailed description.

DETAILED DESCRIPTION

Figure 1:
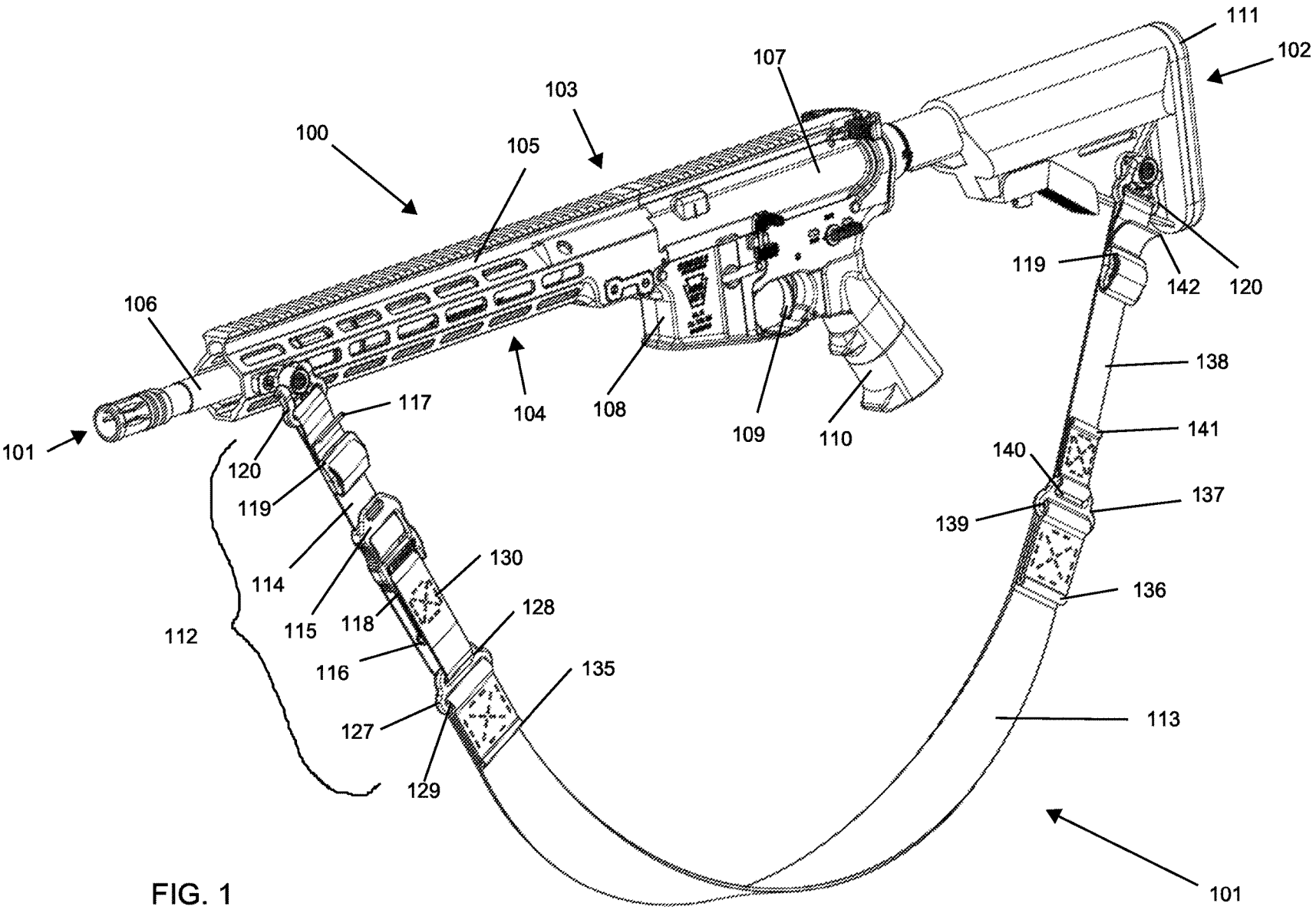
FIG. 1 shows an example adjustable sling for a firearm according to the present disclosure.

The following discussion omits or only briefly describes conventional features of the disclosed technology that are apparent to those skilled in the art. It is noted that various embodiments are described in detail with reference to the drawings, in which like reference numerals represent like parts and assemblies throughout the several views. Reference to various embodiments does not limit the scope of the claims appended hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "comprises" and/or "comprising," when used in this specification, specify the presence of stated features, elements, and/or components, but do not preclude the presence or addition of one or more other features, steps, operations, elements, components, and/or groups thereof.

The disclosed technology relates to an adjustable sling that includes at least a front adjustable portion, a fixed strap, a strap connector, and optionally a loop cord. The front adjustable portion includes at least a primary adjustable strap, a buckle, and a loop cord aperture. The fixed strap has a fixed, non-adjustable length. In some embodiments, the length of the fixed strap is within the range of about 20 inches to about 60 inches, such as about 25 inches to about 50 inches or about 30 inches to about 40 inches. The front adjustable portion and the fixed strap are connected or coupled via a strap connector. The adjustable sling is configured to be attached to a firearm having a handguard, a barrel, an upper receiver, a lower receiver, a trigger, a grip, and a stock.

The primary adjustable strap includes a front end and a back end, the front end being positioned closer to the barrel of the firearm. When the sling is attached to a firearm, the front end of the primary adjustable strap may be permanently secured at or near the front end of the firearm. For example, the front end of the primary adjustable strap may be threaded through and directly and optionally permanently secured to a firearm attachment member having at least one aperture (e.g., a sling swivel, snap hook, buckle, double lock loop, etc.), wherein the firearm attachment member may be mounted directly to the firearm at or near the front end of the firearm. Alternatively, the front end of the primary adjustable strap may be threaded through and directly and optionally permanently secured to an intermediate attachment member having a least one aperture (e.g., a clip, ring, quick-attach), wherein the intermediate attachment member and a separate firearm attachment member directly mounted to the firearm at or near the front end of the firearm are connected or coupled via a portion of the primary adjustable strap. The specific location of attachment at or near the front end of the firearm may vary, including but not limited to locations along the longitudinal length of the handguard such as the frontmost one-third portion, the middle one-third portion, the rearmost one-third portion, the front one-half portion, the back one-half portion, the upper one-half, the lower one-half, and like locations along the upper or lower receiver.

The strap portion at the back end of the adjustable sling may comprise a secondary adjustable strap, a fixed strap, or both, any of which may be secured, optionally via an intermediate attachment member, to a firearm attachment member directly mounted to the firearm at or near the back end of the firearm. The specific location of attachment at or near the back end of the firearm may vary, including but not limited to locations along the longitudinal length of the stock such as the frontmost one-third portion, the middle one-third portion, the rearmost one-third portion, the front one-half portion, the back one-half portion, the upper one-half, the lower one-half, and like locations along the upper or lower receiver.

In one embodiment, a strap may be permanently secured to any type of attachment member having an aperture by threading its end through the attachment member aperture and then optionally folding and attaching the strap end to an adjacent portion of the strap itself, thereby forming a multi-layer (e.g., 2-3 layered) folded loop having a length of about 0.5 to 3 inches, or about 1 inch to about 2 inches. In this embodiment, the folded loop is secured together by sewing, gluing, melting, clamping, or other technique that prevents the strap end from separating from the attachment member. Other means known to those of skill in the art for generally securing a strap to an attachment member, either permanently or non-permanently, are also suitable for use with the disclosed adjustable sling.

When the sling is attached to a firearm, the back end of the primary adjustable strap is threaded through a rapid adjustment buckle having a front end, a back end, and two opposing sides (e.g., left and right sides), the front end being positioned closer to the barrel of the firearm. The rapid adjustment buckle includes a slot and at least three elongated apertures, including a front elongated aperture, a middle elongated aperture, and a back elongated aperture. As used herein, "slot" refers to an aperture of any shape that is located in a structural portion of (i.e., coupled to or integrally formed with) a location towards the front end of the rapid adjustment buckle. For example, in some embodiments, the slot may include a hole (round, elongated, squared, oblong, etc.) in the front end of the rapid adjustment buckle. In other embodiments, the slot may include a protrusion having an aperture configured therethrough. The direction of the slot is not limited and may allow for material to be passed through in a direction parallel to, perpendicular to, or otherwise angled with respect to the longitudinal axis of the rapid adjustment buckle. The front elongated aperture is positioned closest to the barrel of the firearm, the back elongated aperture is positioned furthest from the barrel of the firearm, and the middle elongated aperture is separately positioned between the front and back elongated apertures. Each elongated aperture extends between the sides of the rapid adjustment buckle over a distance that is less than the width of the rapid adjustment buckle. In some embodiments, each elongated aperture is of approximately the same length. Each elongated aperture has a front side, a back side, a left side, and a right side, the front sides being positioned closer to the barrel of the firearm.

The rapid adjustment buckle may also include grips. In some embodiments, the grips include a series of optionally parallel depressions or projections, rounded recesses, rounded projections, or the like, which are at least partially ornamental in nature and are positioned on at least one portion of one or both sides of the rapid adjustment buckle. Additionally the rapid adjustment buckle may have an outer perimeter that includes indented portions (e.g., generally concave portions) that are at least partially ornamental in nature and are positioned on one or both sides of the rapid adjustment buckle to enhance a user's ability to grip the rapid adjustment buckle.

In one embodiment, the back end of the primary adjustable strap may be threaded through the rapid adjustment buckle and a strap connector, the back end of the primary adjustable strap being permanently secured to the rapid adjustment buckle. In some embodiments, the back end of the primary adjustable strap further includes at least one loop cord aperture. In general, the loop cord aperture may have a shape that is elongated, oval, circular, polygonal, or other shape that matches or closely matches the outer shape of the loop cord. The loop cord is a separate length of material that has two ends. In some embodiments, the loop cord permanently or non-permanently attaches to and extends through the loop cord aperture. The loop cord aperture may be formed from a variety of suitable materials or structures within the overall adjustable sling assembly. For example, in one embodiment, the loop cord aperture is formed and defined by a generally folded portion of the primary adjustable strap. In other embodiments, the loop cord aperture is formed and defined by a separate structure or material that may be coupled or permanently secured to a portion of the adjustable sling assembly—e.g., a tag, short strap, or other structure that has an aperture and is secured to a portion of the primary adjustable strap at a location behind the back end of the rapid adjustment buckle, optionally in front of a strap connector. Additionally, the loop cord aperture may be positioned either above or below the upper surface of the primary adjustable strap.

The loop cord can be made from any cord material, including but not limited to paracord (types I, IA, II, IIA, III, IV), general purpose utility cord or rope, or other cord or rope material comprising nylon or a nylon blend. In some embodiments, the diameter of the loop cord is about 2 mm to about 20 mm, such as about 4 mm to about 15 mm, or about 6 mm to about 10 mm. In some embodiments, the inner diameter of the loop cord aperture is only slightly larger than the diameter of the loop cord so as to provide a snug fit.

When the loop cord is attached to the adjustable sling, an opening is defined by two sections of the loop cord, an upper surface of the rapid adjustment buckle, and a corresponding upper surface of the primary adjustable strap. Accordingly, a user carrying the firearm can easily and comfortably slide at least a portion of his/her hand into the opening in order to actuate the rapid adjustment buckle, sliding it backward toward the strap connector or forward toward the front end of the firearm in order to loosen (i.e., lengthen) or tighten (i.e., shorten) the front adjustable portion, respectively, of the adjustable sling.

When the rapid adjustment buckle is located at its forward most position within the front adjustable portion, the configuration of the adjustable sling is at its shortest overall length. In this shortened configuration, and in slightly longer configurations as may be desired by the user, the firearm may be comfortably and securely held close to the user's body, with the firearm in a resting orientation (e.g., barrel pointed to the ground). When the rapid adjustment buckle is located at the rearward most position within the front adjustable portion, the configuration of the adjustable sling is at its longest overall length. In this lengthened configuration, and in slightly shorter configurations as may be desired by the user, the firearm may be comfortably raised or otherwise freely moved from a resting orientation to a shooting orientation. To easily and rapidly move the rapid adjustment buckle between forward and rearward positions, the user simply inserts some or all of the user's hand into the opening, and then slides the rapid adjustment buckle into the desired position so as to achieve the desired overall sling length. In general, the overall length of the adjustable sling should sufficient to extend around at least a portion of a user when the adjustable sling is attached to a firearm.

In some embodiments, the rapid adjustment buckle is formed of a metal material, such as aluminum, titanium, steel, or an alloy thereof. In some embodiments, the adjustable strap and fixed strap are formed from different materials—for example, the fixed strap material may be a more coarse weave than the adjustable strap material. In other embodiments, the adjustable strap and fixed strap are formed from the same material. For example, the adjustable strap may comprise a flat webbing or other flat fabric or material, such as nylon or a nylon blend. In some embodiments, the adjustable strap has a thickness of about 0.2 to about 0.6 inches, such as about 0.04 inches. In some embodiments, the adjustable strap has a width of about 0.7 inch to about 2 inches, such as about 0.8 inch to about 1.5 inch, or about 1 inch to about 1.25 inch.

The strap connector has at least two apertures, including a front aperture and a back aperture, the front aperture being positioned closer to the barrel of the firearm. The fixed strap includes a front end and a back end, the front end being positioned closer to the barrel of the firearm. The front end of the fixed strap may be secured (optionally, permanently secured as described above) to the back aperture of the strap connector. Non-limiting examples of a suitable strap connector include a buckle, eyelet, or other structure that achieves the same purpose.

Non-limiting embodiments of the present disclosure are further described below with reference to the figures.

FIG. 1 shows an example firearm 100 that is defined by a front 101, a back 102, a top 103 and a bottom 104. Throughout this disclosure, references to orientation (e.g., front, frontward, rear, rearward, back, backward, in front, behind, above, below, high, low, back, top, bottom, under, underside, etc.) of structural components shall be defined by that component's positioning in FIG. 1 relative to, as applicable, the front 101, back 102, top 103, and bottom 104 of the firearm 100, regardless of how the firearm 100 may be held and regardless of how that component may be situated on its own (i.e., separated from the firearm 100). The firearm 100 includes a handguard 105, a barrel 106, an upper receiver 107, a lower receiver 108, a trigger 109, a grip 110, and a stock 111.

Figure 5:
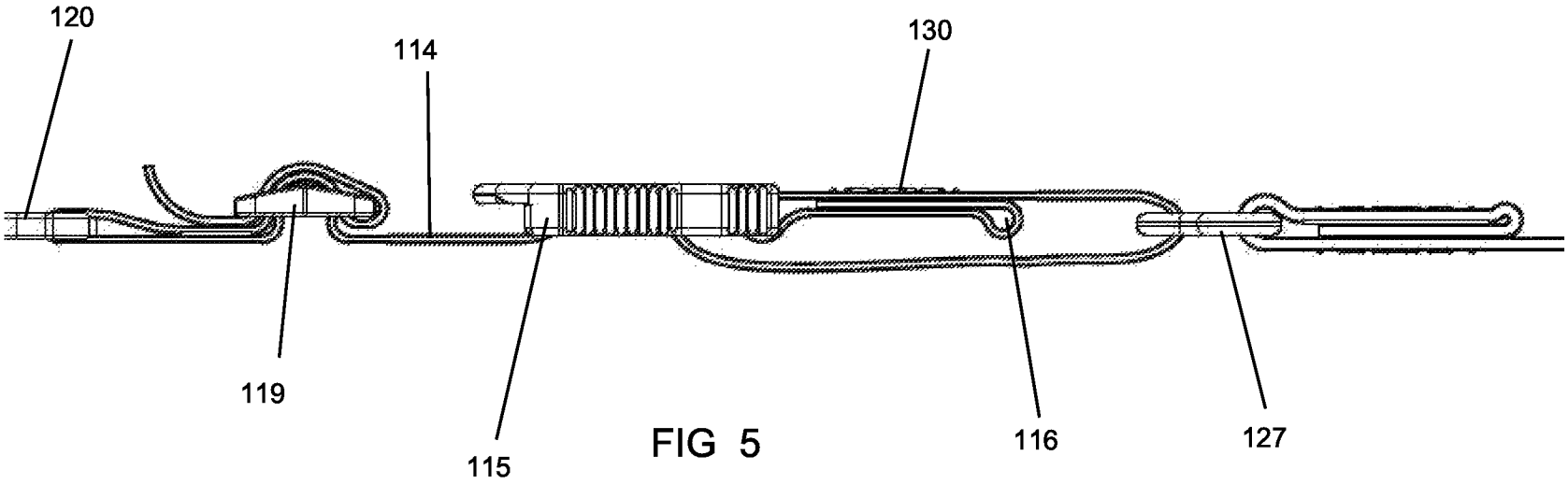
FIG. 5 shows an example of a front adjustable portion of an adjustable sling for a firearm according to the present disclosure.

As shown in FIG. 1, an adjustable sling 101 includes a front adjustable portion 112 (shown in FIG. 5) and a fixed strap 113. The front adjustable portion 112 includes at least a primary adjustable strap 114, a rapid adjustment buckle 115, and a loop cord aperture 116. The adjustable sling 101 is attached to firearm 100 at two locations. The primary adjustable strap 114 includes a front end 117 and a back end 118. In some embodiments, the length of the front adjustable portion can be adjustable within the range of about 5 inches to about 40 inches, such as about 10 inches to about 35 inches, or about 15 inches to about 25 inches.

The front end 117 of the primary adjustable strap 114 extends from an intermediate attachment member 119 having two apertures, a front aperture and a back aperture, the front aperture being positioned closest to the barrel 106 of firearm 100. Working backwards, the front end 117 of the primary adjustable strap 114 threads upwards and through the front aperture of the intermediate attachment member 119 and then downwards and through the back aperture of the intermediate attachment member 119, and then frontwards toward an aperture of a firearm attachment member 120 (depicted as a sling swivel) that is mounted directly to the firearm 100 at a position located in approximately the frontmost one-third portion of the handguard 105.

Figure 3:
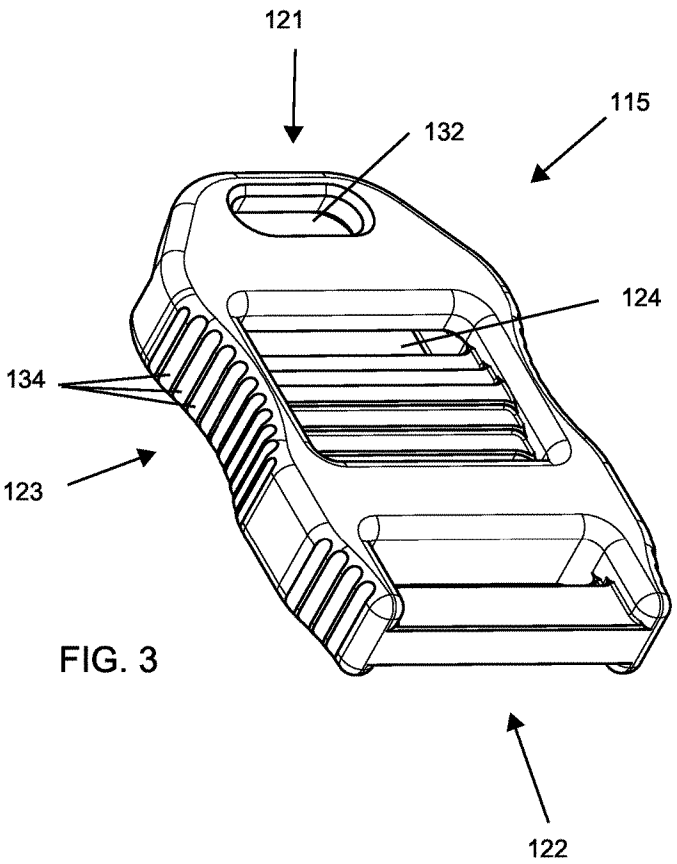
FIG. 3 shows a top, left, back perspective view of the rapid adjustment buckle of FIG. 2.
Figure 2:
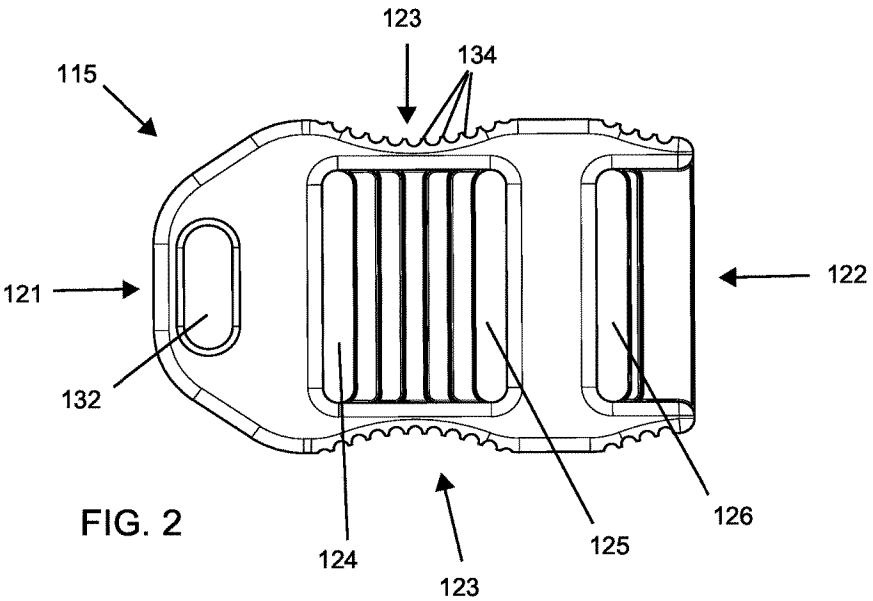
FIG. 2 shows a top view of a rapid adjustment buckle according to the present disclosure.

Continuing on, the primary adjustable strap 114 further threads backwards toward rapid adjustment buckle 115. As shown in FIGS. 2 and 3, the rapid adjustment buckle 115 has a front end 121, a back end 122, and two opposing sides 123 (e.g., left and right sides), the front end 121 being positioned closer to the barrel 106 of the firearm when adjustable sling 101 is attached to firearm 100. The rapid adjustment buckle 115 includes a slot 132, a front elongated aperture 124, a middle elongated aperture 125, a back elongated aperture 126, and concave shaped sides 123 comprising a series of rounded, elongated recesses 134.

As depicted in FIG. 1, the primary adjustable strap 114 threads up through the front elongated aperture 124, entering through an underside of the rapid adjustment buckle 115 and exiting an upper surface of the rapid adjustment buckle 115, further threading down through the middle elongated aperture 125, entering through an upper surface of the rapid adjustment buckle 115 and exiting an underside of the rapid adjustment buckle 115, and then further threading to a strap connector 127. The strap connector 127 has a front aperture 128 and a back aperture 129. The primary adjustable strap 114 thus threads upwards through the front aperture 128 of the strap connector 127, and then returns towards the rapid adjustment buckle 115, where the primary adjustable strap 114 then threads down through the back elongated aperture 126, entering through an upper surface of the rapid adjustment buckle 115 and exiting an underside of the rapid adjustment buckle 115. The primary adjustable strap 114 then extends back and folds into itself such that the back end 118 of the primary adjustable strap 114 is sandwiched between two portions of the primary adjustable strap 114, forming a permanently secured three-layer portion 130 of the primary adjustable strap 114.

The three-layer portion 130 of the primary adjustable strap 114 includes a loop cord aperture 116 formed by the middle and lowermost layers of the three-layer portion 130. As depicted, the loop cord aperture 116 has a cylindrical shape. The loop cord aperture 116 is positioned a distance backward of or below the back end 122 of the rapid adjustment buckle 115, such about 1 inch to about 3 inches, or about 2 inches below the back end 122 of the rapid adjustment buckle 115. As noted above, the loop cord aperture may alternatively be formed and defined by other structures and materials that may be included in the overall adjustable sling assembly.

Figure 4:
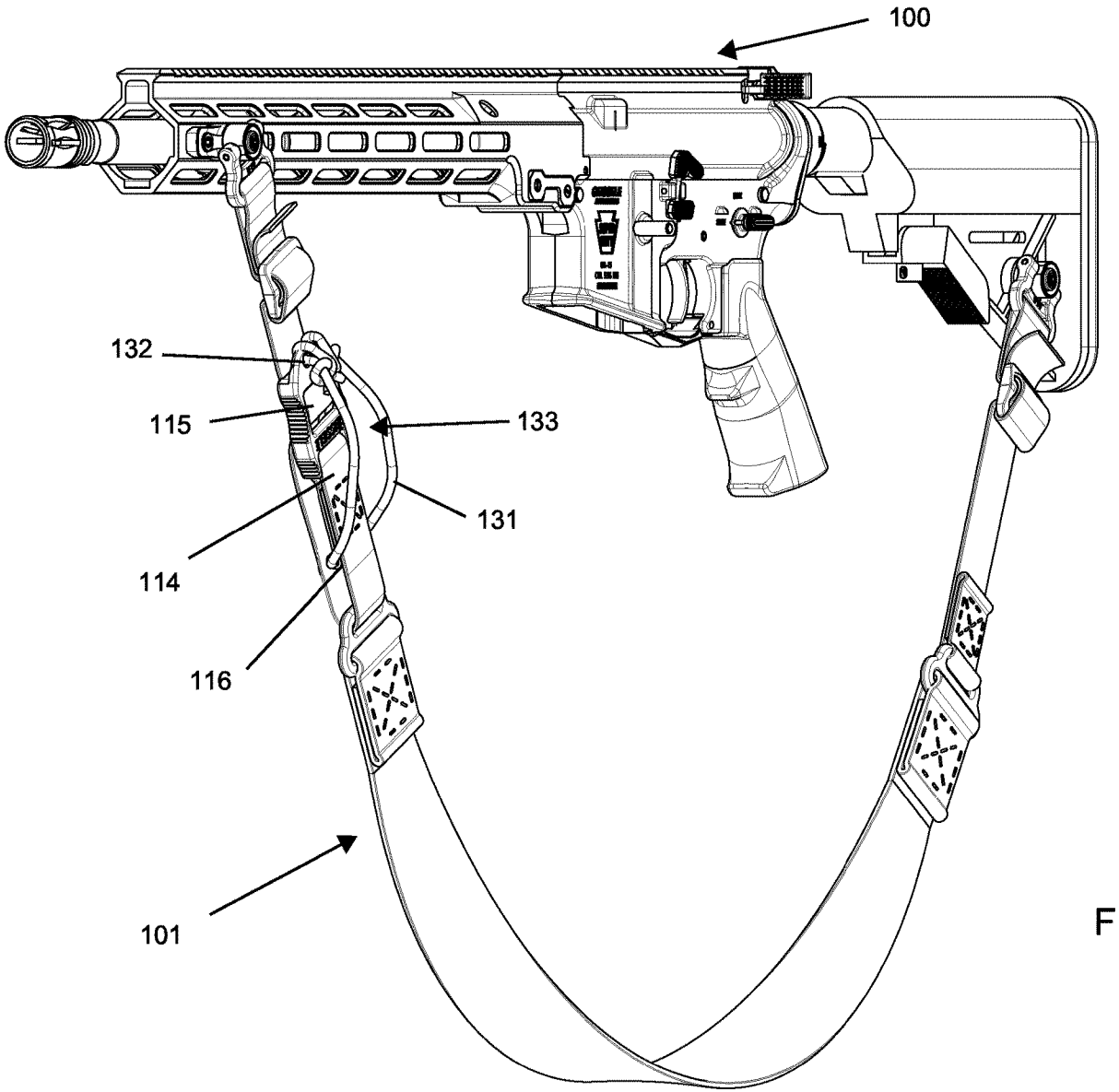
FIG. 4 shows an example adjustable sling with a loop cord according to the present disclosure.

FIG. 4 shows the same example firearm 100 and adjustable sling 101 as shown in FIG. 1 but with a loop cord 131 extending through loop cord aperture 116. As depicted in FIG. 4, a middle portion of the loop cord 131 (not visible) is threaded through the loop cord aperture 116, and the two ends of the loop cord are threaded through slot 132 in the rapid adjustment buckle 115. As depicted, the two ends of loop cord 131 are threaded down through the slot 132, entering an upper surface of the rapid adjustment buckle 115 and exiting a lower surface of the rapid adjustment buckle 115. Two lengths of the loop cord 131 thus remain above the upper surfaces of the rapid adjustment buckle 115 and primary adjustable strap 114, wherein each length generally extends between the slot 132 and the loop cord aperture 116. At the slot 132, the two ends the loop cord 131 are securely tied in a knot together with a remaining portion of the loop cord 131 that was not threaded through the slot 132.

When the loop cord 131 is attached to the adjustable sling 101, an opening 133 is defined by two sections of the loop cord 131, an upper surface of the rapid adjustment buckle 115, and a corresponding upper surface of the primary adjustable strap 114. Accordingly, a user carrying the firearm can easily and comfortably slide at least a portion of his/her hand into the opening in order to actuate the rapid adjustment buckle 115, sliding it backward toward the strap connector 127 or forward toward the front end 101 of the firearm 100 in order to loosen or tighten the front adjustable portion 112, respectively, of the adjustable sling 101.

The front adjustable portion 112 attaches to the fixed strap 113 via strap connector 127. As shown in FIG. 1, the front end 135 of the fixed strap 113 has been threaded through the back aperture 129 of the strap connector 127, folded over onto itself to form a 3-layer folded loop positioned behind the back end of the strap connector 127, and permanently secured. The portion of the fixed strap 113 that is permanently secured may extend a distance of about 1 to about 3 inches, such as about 2 inches behind the back end of the strap connector 127. In the depicted embodiment, the back end 136 of the fixed strap 113 is similarly permanently secured to a second strap connector 137, which has a front aperture 139 and a back aperture 140, the front aperture 139 being positioned closer to the barrel of the firearm. Accordingly the back end 136 of the fixed strap 113 has been threaded through the front aperture 139 of the second strap connector 137, folded over onto itself a distance (e.g., about 1 to about 3 inches, such as about 2 inches) in front of the second strap connector 137, and permanently secured.

As further depicted in FIG. 1, a secondary adjustable strap 138 is positioned back of or behind the second strap connector 137. The front end 141 of the secondary adjustable strap 138 has been threaded through the back aperture 140 of the second strap connector 137, folded over onto itself a distance (e.g., about 1 to about 3 inches, such as about 2 inches) behind or back of the second strap connector 137, and permanently secured. The back end 142 of the secondary adjustable strap 138 has been threaded through an intermediate attachment member 119 to a firearm attachment member 120 and then returned through the intermediate attachment member 119 where it is secured in place. The secondary adjustable strap 138 provides the user with more flexibility in determining the desired overall lengths (i.e., shortest and longest lengths) of the adjustable sling 101. In an alternative embodiment, the secondary adjustable strap 138 and second strap connector 137 may be eliminated such that the fixed strap 113 attaches directly to a firearm attachment member 120 mounted at or near the back end of the firearm 100, optionally through an intermediate attachment member 119. In another alternative embodiment, the fixed strap 113 may be eliminated such that the front adjustable portion 112 attaches via a strap connector 127 directly to the secondary adjustable strap 138, which attaches to a firearm attachment member 120 mounted at or near the back end of the firearm 100, optionally through an intermediate attachment member 119.

The various threading routes described herein provide non-limiting examples of how to couple a strap to a buckle or connector having one or more apertures. Different threading routes (e.g., up through a front, middle, and/or back aperture, down through a front, middle, and/or back aperture, doubling back, etc.) are well understood by those of ordinary skill in the art and are part of the disclosed technology described herein.

In the embodiment depicted in FIG. 1, the adjustable sling is arranged in a two-point configuration. In alternative embodiments, the adjustable sling may be arranged in a one-point or multi-point configuration, as would be understood by those of ordinary skill in the art. For example, in a one-point configuration, one end of the adjustable sling may be attached to a position at or near the back end of the firearm, and an opposite end of the adjustable sling may be attached to a portion of the adjustable sling itself (e.g., near the sling-firearm attachment point), thereby forming a loop that can be worn by the user carrying the firearm.

The foregoing merely illustrates the principles of the disclosure. Any examples set forth in this specification are not intended to be limiting and merely set forth some of the many possible embodiments for the appended claims. Those skilled in the art will readily recognize various modifications and changes that may be made without following the example embodiments and applications illustrated and described herein, and without departing from the true spirit and scope of the following claims.

All references cited and/or discussed in this specification are incorporated herein by reference in their entireties and to the same extent as if each reference was individually incorporated by reference.

What is claimed is:

1. An adjustable sling for a firearm, comprising:

a primary adjustable strap having a front portion and a back portion, wherein the front portion of the primary adjustable strap is configured to be coupled to a firearm attachment member directly mounted at or near a front end of a firearm;

a rapid adjustment buckle comprising three apertures, the rapid adjustment buckle having a front end and a back end;

a strap connector; and a loop cord aperture having a fixed inner diameter, wherein the rapid adjustment buckle is configured to be positioned between the firearm attachment member and the strap connector, and the back portion of the primary adjustable strap is coupled to the rapid adjustment buckle via the strap connector;

the rapid adjustment buckle is configured to slide between the firearm attachment member directly mounted at or near the front end of the firearm and the strap connector; and the loop cord aperture is positioned behind the back end of the rapid adjustment buckle.

2. The adjustable sling of claim 1, wherein a portion of the primary adjustable strap positioned between the rapid adjustment buckle and the strap connector comprises a plurality of layers of strap material, a portion of which defines the loop cord aperture.

3. The adjustable sling of claim 1, wherein the loop cord aperture is configured to receive a loop cord extending therethrough in a snug fit.

4. The adjustable sling of claim 1, further comprising a loop cord extending through the loop cord aperture.

5. The adjustable sling of claim 4, wherein the rapid adjustment buckle further comprises a slot, and the loop cord is coupled to the slot.

6. The adjustable sling of claim 4, wherein the loop cord comprises paracord.

7. The adjustable sling of claim 1, further comprising a fixed strap having a front end and a back end, wherein the strap connector is further coupled to the front end of the fixed strap.

8. The adjustable sling of claim 7, wherein the back end of the fixed strap is configured to be coupled to a firearm attachment member directly mounted at or near a back end of a firearm.

9. The adjustable sling of claim 8, further comprising a secondary adjustable strap positioned between the fixed strap and the firearm attachment member directly mounted at or near the front end of the firearm.

10. The adjustable sling of claim 9, wherein the secondary adjustable strap is coupled to the firearm attachment member directly mounted at or near the front end of the firearm via an intermediate attachment member.

11. The adjustable sling of claim 1, further comprising an intermediate attachment member coupled to the primary adjustable strap and positioned in front of the front end of the rapid adjustment buckle.

12. The adjustable sling of claim 1, wherein the rapid adjustment buckle comprises grips on two opposing sides of the rapid adjustment buckle.

13. A firearm comprising the aft adjustable sling of claim 1.

14. The firearm of claim 13, wherein the firearm comprises a handguard and the front portion of the primary adjustable strap is coupled to a firearm attachment member directly mounted to the handguard.

15. An adjustable sling for a firearm, comprising:

a first strap comprising a front portion configured to engage a firearm attachment member directly mounted at or near a front end of the firearm, and a back portion;

a rapid adjustment buckle slidably positioned on the first strap and comprising a first portion with a first and a second elongated aperture formed therein, the first elongated aperture being spaced apart from the second elongated aperture, the rapid adjustment buckle being configured so that the strap enters and exits buckle by way of the first and second elongated apertures as the buckle slides along the first strap;

a strap connector configured to couple the first strap to a second strap; and a loop cord aperture positioned behind the back end of the rapid adjustment buckle and having a fixed inner diameter;

wherein the first strap is configured to loop around a portion of the strap connector, and the back portion of the first strap is permanently secured to a second portion of the rapid adjustment buckle so that the first strap forms a loop between the rapid adjustment buckle and the strap connector, and wherein sliding the rapid adjustment buckle toward the strap connector decreases a size of the loop and increases a length of the strap between the firearm attachment member and the strap connector.

16. The adjustable sling of claim 15, wherein sliding the rapid adjustment buckle away from the strap connector increases a size of the loop and decreases the length of the strap between the firearm attachment member and the strap connector.

17. The adjustable sling of claim 15, wherein the first strap loops around the portion of the strap connector after exiting the rapid adjustment buckle.

18. The adjustable sling of claim 15, wherein the first strap loops around the portion of the strap connector by way of an aperture in the strap connector.

19. The adjustable sling of claim 15, wherein the first strap further comprises an intermediate portion located between the front and back portions, and the rapid adjustment buckle is further configured to slide along the intermediate portion.

20. The adjustable sling of claim 15, wherein the fixed inner diameter is sized to create a snug fit around a loop cord having a diameter of about 2 mm to about 20 mm.

21. A firearm comprising the adjustable sling of claim 15.

22. An adjustable sling assembly, comprising the adjustable sling of claim 15 and a loop cord.

* * * * *